US005260122A

United States Patent [19]

Prevorsek et al.

[11] Patent Number: 5,260,122

[45] Date of Patent: Nov. 9, 1993

[54] IMPACT RESISTANT WOVEN BODY

[75] Inventors: Dusan C. Prevorsek, Morristown; Young D. Kwon, Mendham; Hong B. Chin, Parsippany, all of N.J.

[73] Assignee: Allied-Signal Inc., Morris Township, Morris County, N.J.

[21] Appl. No.: 755,249

[22] Filed: Sep. 5, 1991

[51] Int. Cl.[5] ..... D03D 3/00

[52] U.S. Cl. ..... 428/225; 244/145; 244/151 R; 428/364; 428/397; 428/398; 428/911

[58] Field of Search ..... 428/225, 911, 364, 397, 428/398; 244/145, 151 R

[56] References Cited

U.S. PATENT DOCUMENTS 4,613,535 9/1986 Harpell et al. ..... 428/911
4,623,574 11/1986 Harpell et al. ..... 428/911
4,650,710 3/1987 Harpell et al. ..... 428/911
4,678,702 7/1987 Lancaster et al. ..... 428/911
4,732,803 3/1988 Smith ..... 428/911
4,737,401 4/1988 Harpell et al. ..... 428/911
4,748,064 5/1988 Harpell et al. ..... 428/911

OTHER PUBLICATIONS

L.L.-W-4088K, Nov. 21, 1988.

D. C. Prevorsek et al., "Dynamics of the Parachute Sling: Testing Procedures and Evaluations", Allied-Signal Inc., pp. 1-10, (1990).

*Primary Examiner*—James J. Bell

[57] ABSTRACT

This invention is related to a woven fibrous article which exhibits relatively low reductions in energy-to-break and tenacity on repeated impacts.

43 Claims, 11 Drawing Sheets

IMPACT RESISTANT WOVEN BODY

BACKGROUND OF THE INVENTION

1. Field of the Invention

This invention relates to an improved impact resistant woven body which exhibits a relatively low reduction in tensile properties (i.e. tenacity, energy-to-break, tensile modulus etc) on repeated tensile impacts and to articles of manufacture which comprise said woven body. In a more preferred aspect, this invention relates to an improved parachute sling for connection of an animate or inanimate cargo to a parachute and to a parachute and sling combination which comprises the improved sling of this invention.

2. Prior Art

Animate and inamimate cargo are often aerially deployed using a combination of a parachute, cargo and a sling composed of multiple plies of fibrous webbing connecting the cargo to the parachute lines. During the deployment of the parachute, the sling experiences impact caused by rapid deceleration of the parachute. It is desired that the sling is constructed of such material to enable the sling to withstand repeated impacts. Heretofore, it was believed that the tensile strength of the sling was of primary importance.

SUMMARY OF THE INVENTION

One aspect of this invention relates to a woven article of manufacture which is woven from a plurality of polymeric fibers having a tenacity equal to or greater than about 5 grams/denier and wherein said fibers are selected such that the ratio of energy-to-break (lbf-in/in) of said article to the tensile strength (lbf) of said article is greater than about 0.105, wherein said fibers are selected such that the energy-to-break of said article after the Impact Resistance Test (See Example 1(II) (B)) is at least about 45% of the energy-to-break of said article before testing and the tensile strength of said article after said Impact Resistance Test is at least about 75% of the tensile strength of said article before testing. In a preferred embodiment, this invention relates to an improved parachute cargo attaching article of manufacture for attachment of an animate or inanimate cargo to a parachute for air deployment of the type comprising an elongated woven body woven from a plurality of polymeric fibers, said improvement comprising fibers having a tenacity equal to or greater than about 5 grams/denier and wherein said fibers are selected such that the ratio of the energy-to-break (lbf-in/in) of said body to the tensile strength (lbf) of said body is greater than about 0.100, wherein said fibers are selected such that the energy-to-break of said article after the Impact Resistance Test (See Example 1(II) (B)) is at least about 45% of the energy-to-break of said article before testing and the tensile strength of said article after said Impact Resistance Test is at least about 75% of the tensile strength of said article before testing.

Yet another aspect of this invention relates to a combination of the parachute cargo attaching article of this invention and a parachute and/or an animate or inanimate cargo.

The present invention relates to polymeric fibers which in woven constructions exhibit an unexpected capability to withstand repeated tensile impacts with relatively lower reductions in tensile properties. By this invention, it has been discovered that the key property for improved retention of tensile properties on repeated tensile impacts is the energy-to-break of the fiber and the extent to which the energy-to-break of the fiber is translated into the energy-to-break of the woven body. The key fiber characteristics which effect the translational effeciency of fiber energy-to-break into energy-to-break of the woven structure have been identified. Suprisingly, it has been discovered that the mechanical properties of the yarn are insufficient to predict the outstanding impact behavior of the body. Furthermore, the results could not be explained or anticipated on the basis of the macrostructure of the fiber (morphology) using known structure property relationships.

BRIEF DESCRIPTION OF THE DRAWINGS

The invention will be more fully understood and further advantages of the invention will become apparent when reference is made to the following detailed description of the invention and accompanying drawings in which.

DESCRIPTION OF THE PREFERRED EMBODIMENTS

Figure 1:
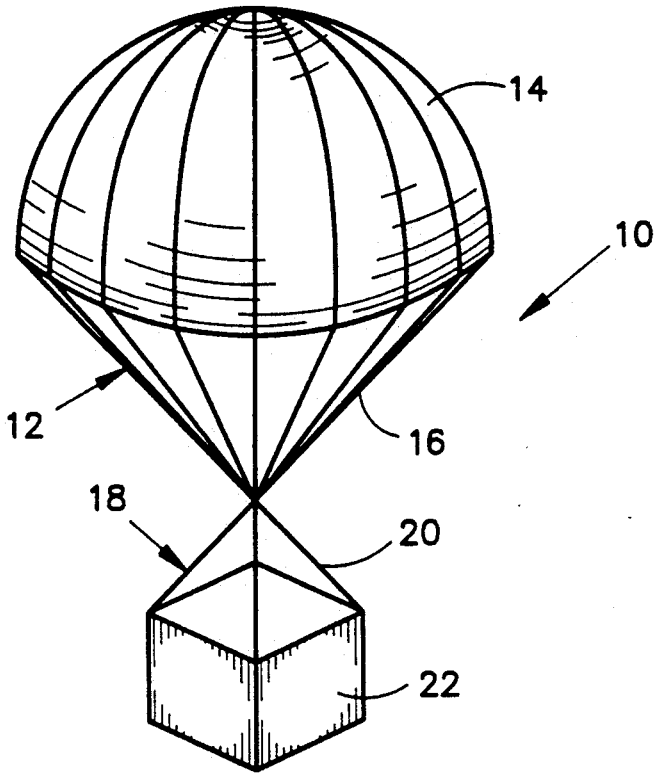
FIG. 1 is a depiction of a deployed parachute comprising the woven article of this invention with an attached cargo.

This invention relates to a fibrous elongated woven structure having improved properties which is especially useful as sling for connection of cargo to a parachute for aerial deployment. As used herein, "elongated" indicates that the length dimensions of the structure is greater than the transverse dimensions of width and thickness. As used herein, "woven" means that the structure is formed from fibers which are fed in the form of yarn strands interlaced as warp and fill according to a specified geometrical relationship. Woven structures and means and methods for their manufacture are well known in the art. Such conventional weaving equipment and procedures can be employed provided that the final tensile properties of the woven body, energy-to-break (lbf-in/in) and tensile strength (lbf), and the effect of Impact Resistance Testing on these tensile properties as described above.

The woven body of this invention has several critical requirements with regard to the relative ratio of the energy-to-break (lbf-in/in) to the tensile strength (lbf) of the article, and the effect of Impact Resistance Testing on energy-to-break and tensile strength. The ratio of the energy-to-break (lbf-in/in) to tensile strength (lbf) of the body is greater than about 0.105. The energy-to-break and the tensile strength of the body are measured by the procedure of Federal Test Method Standard No. 191 A. The ratio of energy-to-break to tensile strength (lbf) of the body is preferably equal to or greater than about 0.11, more preferably is from about 0.11 to about 0.125 and is most preferably from about 0.11 to about 0.15. In general, the article of this invention will retain at least about 50% of its energy-to-break and at least about 30% of its tensile strength after Impact Resistance Test. In the preferred embodiments of the invention, the woven body of this invention will retain at least about 40% of its energy-to-break and at least about 80% of its tensile strength after Impact Resistance Testing, and in the more preferred embodiments will retain at least about 44% of its original impact resistance and at least about 84% of its tensile strength after Impact Resistance Testing. In the most preferred embodiments of the invention, the body will retain at least about 48% of its energy-to-break and at least about 87% of its tensile strength after Impact Resistance Testing.

The actual energy-to-break and tensile strength values of the article for use in any particular situation will vary widely depending on a number of factors including the size of the parachute and cargo. In a typical example, where the woven body has 1,256,000 denier (about 0.14 kg/m) the tensile strength of the body is at least about 6818 kilograms (15000 lbf) and, preferably at least about 7045 kilograms (15500 lbf). The energy-to-break of the article is usually equal to or greater than about 54 Joules/gram (J/g) (1695 lbf-in/in) and the "translational efficiency" of fiber energy-to-break into energy-to-break of the structure is at least about 90%. As used herein, "translational efficiency" is the ratio of strength or energy to break of the woven body to that of the yarn from which the structure was woven. The energy-to-break of the woven structure is preferably equal to or greater than about 55 J/g (1730 lbf-in/in), and the translational efficiency is at least about 94%. More preferably, equal to or greater is than about 65 J/g (2040 lbf-in/in), and the translational efficiency is at least about 111%, and most preferably the energy-to-break of the structure si equal to or greater than about 70 J/g (2200 lbf-in/in) and the translational efficiency is at least about 120%.

The fiber used in the body of this invention may vary widely provided that the fiber in the woven article has a tenacity of at least about 5 grams/denier (g/d) and has an energy-to-break of at least about 50 J/g. In the preferred embodiments of the invention, the tenacity of the fiber in the woven article is equal to or greater than about 6 g/d, and the energy-to-break of the fiber in the woven article is at least about 55 J/g. In the more preferred embodiments of the invention, the tenacity of the fiber in the woven article is from about 6 to about 12 g/d, the energy-to-break of the fiber in the woven article is from about 50 to about 80 J/g.

The melting point of the polymer forming the fiber may vary widely and will in general depend on the use conditions of the woven structure. In general, the melting point of the polymer is greater than the maximum temperature of the use environment and the temperature generated during use. In the preferred embodiments of this invention, the melting point of the fiber is equal to or greater than about 195° C. The upper limit to the melting point range is not critical provided that the polymer can be processed into a fiber using conventional techniques. More preferred melting points are at least about 220° C., most preferred melting points are at least about 210° C. and melting points-of choice are equal to or greater than about 220° C.

While we do not wish to be bound by any theory, it is believed that the crystallite length distribution is critical to the extent to which the energy-to-break and the tenacity of the woven structure are reduced in the Impact Resistance Test. In general, the crystallite length is from about 50 to about 65 Å as measured by wide angle x-ray diffraction. In the preferred embodiments the crystallite length is equal to or less than about 58 Å, more preferred crystallite length is equal to or less than about 56 Å and most preferred crystal length is about 54 Å. In general, it is believed that the lower the degree of crystallinity (as measured by X-ray diffraction analysis) and lower the heat of fusion (as measured by differential scanning colarimetry (DSC) and/or the lower the crystallization rate coefficient and/or the shorter the crystal length and the greater the periodicity in the crystalline dimensions of the fiber (as measured by X-ray defraction), the greater the extent to which the woven structure retains its tensile strength and energy-to-break on repeated impacts. It is also believed that the chain direction of the polymer's crystal is critical to the % retention of energy-to-break and tenacity and that % retention is higher where chain directions are anti-parallel as measured by x-ray defraction analyses.

The degree of crystallinity of the fiber is preferably less than about 70%, the heat of fusion is preferably less than about 64 J/g, and the periodicity of the crystalline dimension along the fiber axis (Scherrer Length) is greater than about 250 Å. In the preferred embodiments of the invention, the degree of crystallinity of the fiber is equal to or less than about 65%, the heat of fusion is less than about 60 J/g and the periodicity in the crystalline dimension along the fiber axis is equal to or greater than 350 Å. In the more preferred embodiments of the inventions, the degree of crystallinity of the fiber is equal to or less than about 65%, the heat of fusion is equal to or less than about 59 J/g and the periodicity is equal to or greater than about 450 Å. In the most preferred embodiments of the invention, the degree of crystallinity of the fiber is equal to or less than about 60%, the heat of fusion is equal to or less than about 58 J/g and the periodicity in the crystalline dimension along the fiber length is equal to or greater than about 550 Å. Those embodiments of the invention in which the periodicity in the crystalline dimension along the fiber length is equal to or greater than about 650 Å and more preferably equal to or greater than about 750 Å are the embodiments of choice.

The fiber used in the body of this invention may vary widely provided that the fiber in the woven article has a tenacity of at least about 5 grams/denier (g/d) and has an energy-to-break of at least about 50 J/g. In the preferred embodiments of the invention, the tenacity of the fiber in the woven article is equal to or greater than about 6 g/d, and the energy-to-break of the fiber in the woven article is at least about 58 J/g. In the more preferred embodiments of the invention, the tenacity of the fiber in the woven article is from about 6 to about 12 g/d, the energy-to-break of the fiber in the woven article is from about 50 to about 80 J/g.

The fibers can be prepared from any polymeric material i.e. homopolymer, copolymer or blends of one or more of the foregoing. Illustrative of polymers which are useful in the practice of this invention are polyamides, polyesters and polymers derived from the polymerization of $\alpha$, $\beta$- unsaturated monomers. Illustrative of useful polyamides are those characterized by the presence of recurring carbonamide groups as an integral part of the polymer chain which are separated from one another by at least two carbon atoms. These polyamides are those prepared by reaction of diamines and diacids having the recurring unit represented by the general formula:

NHCORCONHR[1]

in which R is an alkylene group of at least about two carbon atoms or arylene of at least 6 carbon atoms, preferably alkylene having from about 2 to about 10 carbon atoms or phenylene, and $R^1$ is R or aryl. Exemplary of such materials are poly(hexamethylene adipamide) (nylon 6,6) poly(hexamethylene sebacamide) (nylon 6,10), poly(hexamethylene isophthalamide), poly(hexamethylene terephthalamide), poly(heptamethylene pimelamide) (nylon 7,7), poly(octamethylene suberamide) (nylon 8,8), poly(nonamethylene azelamide) (nylon 9,9), poly(decamethylene azelamide) (nylon 10,9), poly (decamethylene sebacamide) (nylon 10,10), poly(bis(4-amino cyclohexyl)methane-1,10-decanecarboxamide)] (Quiana), poly(m-xylylene adipamide), poly(p-xylylene sebacamide), poly(2,2,2-trimethyl hexamethylene terphthalamide), poly(piperazine sebacamide), poly(p-phenylene terephthalamide), poly(metaphenylene isophthalamide) and the like.

Other useful polyamides are those formed by polymerization of amino acids and derivatives thereof, as for example lactams. Illustrative of useful polyamides are poly(4-aminobutyric acid) (nylon 4), poly(6-aminohexanoic acid) (nylon 6), poly(7-aminoheptanoic acid) (nylon 7), poly(8-aminocatanoic acid) (nylon 8), poly(9-aminononanoic acid) (nylon 9), poly(10-aminodecanoic acid) (nylon 10), poly(11-aminoundecanoic acid) (nylon 11), poly(12-aminododecanoic acid) (nylon 12) and the like.

Preferred polyamides for use in the practice of this invention are polycaprolactam (nylon 6), poly (hexamethylene adipamide) (nylon 6,6), poly(11-amino undecanoic acid) (nylon 11), and poly (hexamethylene sebacamide) (nylon 6,10). The particularly preferred polyamided are polycaprolactam and poly(hexamethylene adipamide), and poly (caprolactam) is the most preferred polyamide.

The particular polyester chosen for use can be a homo-polyester or a co-polyester, or mixtures thereof as desired. Polyesters are normally prepared by the condensation of an organic dicarboxylic acid and an organic diol, and, therefore, illustrative examples of useful polyesters will be described herein below in terms of these diol and dicarboxylic acid precursors.

Polyesters which are suitable for use in this invention are those which are derived from the condensation of aromatic, cycloaliphatic, and aliphatic diols with aliphatic, aromatic and cycloaliphatic dicarboxylic acids. Illustrative of useful aromataic diols, are those having from about 6 to 12 carbon atoms. Such aromatic diols include bis-(p-hydroxyphenyl)-methane; 1,2-(bis-(p-hydroxphenyl)-ethane; 1-phenyl-(bis-(p-hydroxphenyl)-methane; dipheny-(bis-(p-hydroxphenyl)-methane; 2,2-bis(4'-hydroxy-31-dimethylphenyl)propane; 1,1- or 2,2-(bis(p-hydroxphenyl)-butane; 1,1-dichloro-or 1,1,1-trichloro-2,2-(bis(p-hydroxyphenyl)-ethane; 1,1-(bis(p-hydroxphenyl)-cyclopentane; 2,2-(bis-(p-hydroxyphenyl)propane (bisphenol A); 1,1-(bis(p-hydroxphenyl)cyclohexane (bisphenol C); p-xylene glycol; 2,5-dichloro-p-xylylene glycol; p-xylene $\alpha$, $\beta$-diol; and the like.

Suitable cycloaliphatic diols include those having from about 5 to about 8 carbon atoms. Exemplary of such useful cycloaliphatic diols are 1,4-dihydroxy cyclohexane; 1,4-dihydroxy methylcyclohexane; 1,3-dihydroxycycloheptane; 1,5-dihydroxycyclooctane; 1,4-cyclohexane dimethanol; and the like. Polyesters which are derived from aliphatic diols are preferred for use in this invention. Useful and preferred aliphatic diols include those having from about 2 to about 12 carbon atoms, with those having from about 2 to about 6 carbon atoms being particularly preferred. Illustrative of such preferred diol precursors are 1,2-or 1,3-propylene glycol; ethylene glycol, neopentyl glycol, pentyl glycol, 1,6-hexanediol, 1,4-butanediol and geometrical isomers thereof. Propylene glycol, ethylene glycol and 1,4-butanediol are particularly preferred as diol precursors of polyesters for use in the conduct of this invention.

Suitable dicarboxylic acids for use as precursors in the preparation of useful polyesters are linear and branched chain saturated aliphatic dicarboxylic acids, aromatic dicarboxylic acids and cycloaliphatic dicarboxylic acids. Illustrative of aliphatic dicarboxylic acids which can be used in this invention are those having from about 2 to about 5 carbon atoms, as for example, oxalic acid, malonic acid, dimethylmalonic acid, succinic acid, octadecylsuccinic acid, pimelic acid, adipic acid, trimethyladipic acid, sebacic acid, subric acid, azelaic acid and dimeric acids (dimerisation products of unsaturated aliphatic carboxylic acids such as oleic acid) and alkylated malonic and succinic acids, such as octadecylsuccinic acid, and the like.

Illustrative of suitable cycloaliphatic dicarboxylic acids are those having from about 6 to about 15 carbon atoms. Such useful cycloaliphatic dicarboxylic acids include 1,3-cyclobutanedicarboxylic acid, 1,2-cyclopentanedicarboxylic acid, 1,3- and 1,4-cyclohexane-dicarboxylic acid, 1,3- and 1,4-dicarboxymethylcyclohexane and 4,4'-dicyclohexyldicarboxylic acid, and the like.

Polyester compounds prepared from the condensation of a diol and an aromatic dicarboxylic acid are preferred for use in this invention. Illustrative of such useful aromatic carboxylic acids are terephthalic acid, isophthalic acid and a o-phthalic acid 1,3-, 1,4, 2,6 or 2,7-naphthalenedicarboxylic acid, 4,4'-diphenyldicarboxylic acid, 4,4'-diphenylsulphonedicarboxylic acid, 1,1,3-trimethyl-5-carboxy-3-(p-carboxy-phenyl)-indane, diphenyl ether 4,4'-dicarboxylic acid bis-p(carboxyphenyl) methane and the like. Of the aforementioned aromatic dicarboxylic acids based on a benzene ring such as terephthalic acid, isophthalic acid orthophthalic acid are preferred for use and amongst these preferred acid precursors, terephthalic acid is particularly preferred.

Preferred polyester for use in the practice of this invention, poly(ethylene terephthalate), poly(butylene terephthalate), and poly(1,4-cyclohexane dimethylene terephthalate), are the polyesters of choice. Among these polyesters of choice, poly(ethylene terephthalate) is most preferred.

Illustrative of useful fibers formed by polymerization of $\alpha$, $\beta$-unsaturated monomers are those formed from monomers of the formula:

$$R_1 R_2—C{=}CH_2$$

wherein: $R_1$ and $R_2$ are the same or different and are hydrogen, hydroxy, halogen, alkylcarbonyl, carboxy, alkyoxycarbonyl, heterocycle or alkyl or aryl either unsubstituted or substituted with one or more substituents selected from the group consisting of alkoxy, cyano, hydroxy, alkyl and aryl. Illustrative of such polymers of $\alpha$, $\beta$-unsaturated monomers are polymers including polystyrene, polyethylene, polyproplyene, poly(l-octadecene), polyisobutylene, poly(1-penetene), poly(2-methylstyrene), poly(4-methylstyrene), poly(1-hexene), poly(1-pentene), poly(4-methoxystrene), poly(5-methyl-1-hexene), poly(4-methylpenetene), poly(1-butene), polyvinyl chloride, polybutylene, polyacrylonitrile, poly(methyl penetene-1), poly(vinyl alcohol), poly(vinyl-acetate), poly(vinyl butyral), poly(vinyl chloride), poly(vinylidene chloride), vinyl chloride-vinyl acetate chloride copolymer, poly(vinylidene fluoride), poly(methyl acrylate, poly(methyl methacrylate), poly(methacrylo-nitrile), poly(acrylamide), poly(vinyl fluoride), poly(vinyl formal), poly(3-methyl-1-butene), poly(1-pentene), poly(4-methyl-1-butene), poly(1-pentene), poly(4-methyl-1-pentene, poly(1-hexane), poly(-vinyl-cyclopentane), poly(vinylcyclothexane), poly($\alpha$-vinyl-naphthalene), poly(vinyl methyl ether), poly(vinyl-ethylether), poly(vinyl propylether), poly(vinyl carbazole), poly(vinyl pyrlidone), poly(2-chlorostyrene), poly(4-chlorostyrene), poly(vinyl formate), poly(vinyl butyl ether), poly(vinyl octyl ether), poly(vinyl methyl ketone), poly(methylisopropenyl ketone), poly(4-phenylstyrene) and the like. Preferred polymers formed from the polymerization of $\alpha$, $\beta$-unsaturated monomers are poly acrylonitrile fibers, polyvinyl chloride fibers, polyvinylidene chloride fibers, polyvinyl alcohol fibers, poly tetrafluoroethylene fibers, poly vinylidene dinitrile fibers, polystyrene fibers, poly ethylene fibers and poly propylene fibers. Most preferred are poly ethylene fibers.

Among the various polymeric fibers, more preferred fibers are those formed from aliphatic polyamides, such as nylon polyamide 6, nylon 6,6, nylon 11 and nylon 6,10. Most preferred polyamide fibers are those formed from nylon 6 and nylon 66, with fibers formed from nylon 6 being the fibers of choice.

The number of filaments per cross-section may vary widely depending on many factors such as weaving techniques and intended use. The woven structure of this invention preferably includes at least about $2\times10^5$ filaments per cross-sectional area of ($0.0017CM^2$).

For purposes of the present invention, fiber is defined as an elongated body, the length dimension of which is much greater than the dimensions of width and thickness. Accordingly, the term "fiber" as used herein includes a monofilament elongated body, a multifilament elongated body, ribbon, strip, and the like having regular or irregular cross-sections. The term fibers includes a plurality of any one or combination of the above. In the preferred embodiments, the fiber is multifilament.

The cross-section of fibers for use in this invention may vary widely. Useful fibers may have a circular cross-section, oblong cross-section or irregular or regular multi-lobal cross-section having one or more regular or irregular lobes projecting from the linear or longitudinal axis of the fibers. In the particularly preferred embodiments of the invention, the fibers are of substantially circular or oblong cross-section and in the most preferred embodiments are of circular of substantially circular cross-section.

The tensile modulus of the fiber is equal to or greater than about 50 grams/denier and the tenacity of the fiber is equal to or greater than about 5 grams/denier. All tensile properties are evaluated by pulling a 10 in (25.4 cm) fiber length clamped in barrel clamps at a rate of 10 in/min (25.4 cm/min) on an Instron Tensile Tester. In the preferred embodiments of the invention, the tensile modulus is from about 50 to about 55 grams/denier and the tenacity is from about 5 to about 8 grams/denier.

The woven structure of this invention can be fabricated using conventional weaving techniques. These techniques are well known in the art and will not be described herein any great detail. Illustrative of useful weaving techniques are those described in U.S. Military Specification MIL - W - 4088 which is hereby incorporated by reference. It is preferred that the weaving techniques are those which do not adversely affect the tensile properties of the fibers forming the woven structure to an undue extent. In general, the tenacity of the fiber after weaving is at least about 60%, more preferably at least about 70% and most preferably at least about 80% of the original fiber tenacity.

The woven body of this invention can be used for any conventional purpose for which such bodies can be used. For example, the woven body can be used for slings in air-dropping of cargo, aircraft stopping webbing, seat belts and various harnessing. The woven body of this invention is especially useful in those applications where it is subjected to repeated impact stresses. As used herein, "impact stress" is the loading stress imposed on the woven body when the body which is harnessed by the woven body undergoes jolting movement because of deceleration or acceleration. Such applications, include seat belts, slings for parachutes, aircraft - stopping webbing and various harnesses associated with moving equipments.

The body of this invention is preferably used in the aerial deployment of inanimate and animate objects. As depicted in FIG. 1, such deployment is made by combination 10 which comprises a parachute 12 comprising a canopy 14 and lines 16 attached to sling 18 comprising one or more woven bodies of this invention 20 and optionally a cargo 22 (i.e. any animate or inanimate object which is intended to be aerially deployed by the parachute) attached to sling 18. Parachutes and parachute designs, and materials and procedures for fabrication modes of then operation are well known in the art. For example, U.S. Pat. Nos. 4,928,909; 4,015,801; 3,285,546; 3,749,337; 3,724,789; 3,524,613; 3,412,963; 3,393,885; 3,428,277; 3,131,894; 1,780,190; 4,406,433; 3,972,495; and 4,129,272;

The following example is presented to more particularly illustrate the invention and should not be construed as a limitation thereon.

EXAMPLE 1

A series of experiments were carried out to demonstrate the unique advantages of this invention. These experiments are as follows:

I. Fiber Evaluation

Nylon 6 (1,725 denier/272 filaments) and nylon 66 (1,685 denier/280 filaments) were selected for the evaluation. Prior to use in the fabrication of the woven article of this invention, the tensile properties (tensile strength, tensile modlus, elongation to break) and the morphology (degree of crystalinity, heat of fusion, specific heat of fusion, and coherent length (long period destribution)) of the fibers were evaluated.

Figure 2:
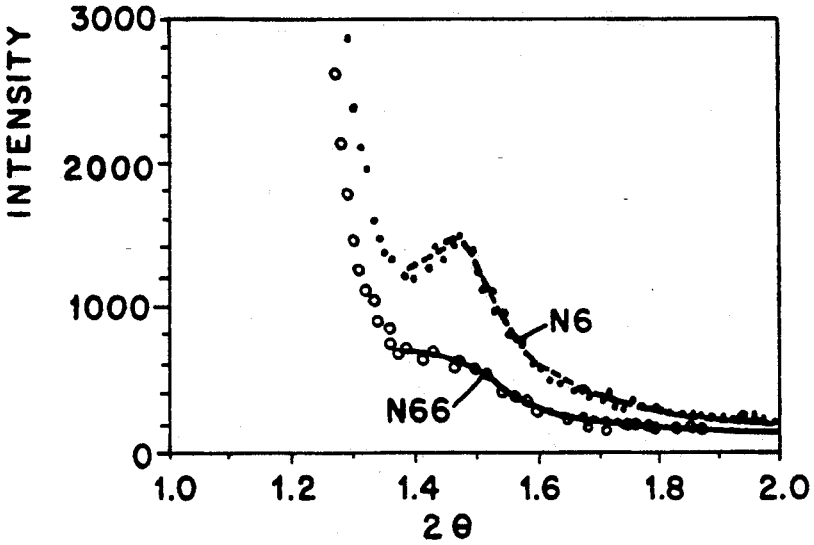
FIG. 2 are small-angle X-ray scattering curves of nylon 6 and nylon 66.
Figure 3:
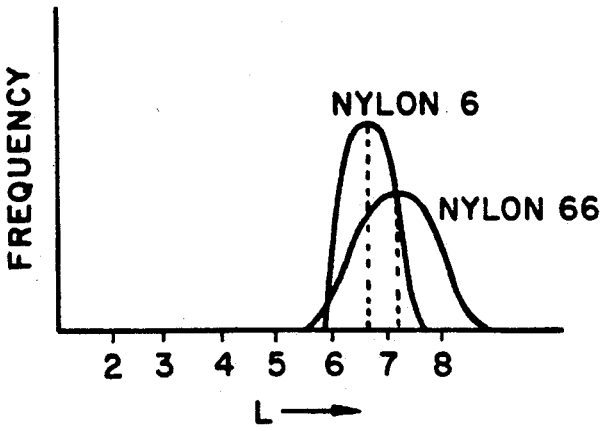
FIG. 3 are schematic of the long period distribution in nylon 6 and nylon 66.

The tensile properties were evaluated by the procedure of ASTM D2256, using an Instron type testing apparatus with a 10 inch gauge length under a strain rate of 100%/min. The degree of crystallinity was determined by wide angle X-ray diffraction method. (For reference, see L. E. Alexander, X-ray Diffraction Method in Polymer Science. J. Wiley, NY, 1969.) The heat of fusion and the specific heat of fusion were determined by differential scanning calorimetry (DSC) using DuPont DSC Model 9900. The coherent length (Scherer length) was obtained from small-angle x-ray scattering curves for nylon 6 and nylon 66 set forth in FIGS. 2 and 3 using the Scherrer equation $$l_{coh}=\alpha/[\Delta(2\theta)\cos\theta]$$

where $\alpha$ is equal to 0.9 $\lambda$($\lambda$ is wave length of X-ray), $\Delta$ is the full width at half maximum and $\theta$ is one half the scattering angle. The results of these experiments are set forth in the following Table I.

TABLE I

| Exp. No. | Property | Nylon 66 control | Nylon 6 |
|---|---|---|---|
| a) | Degree of Crystallinity (%) | 70 | 60 |
| b) | Heat of Fusion (J/g) | 64 | 58 |
| c) | Specific Heat of Fusion (J/g %) | 0.91 | 0.87 |
| d) | Scherrer Length (Å) | 250 | 800 |
| e) | Tenacity (grams/denier) | 9.38 | 8.03 |
| f) | Energy to break (J/g) | 58.58 | 58.53 |
| g) | Tensile Modulus (grams/denier) | 58.26 | 58.53 |

TABLE I-continued

| Exp. No. | Property | Nylon 66 control | Nylon 6 |
|---|---|---|---|
| h) | Denier | 1,685 | 1,725 |
| i) | Filaments per Fiber | 280 | 272 |
| j) | Elongation-to-break (%) | 15.57 | 16.26 |
| k) | length of crystallite (Å) | 60.7 | 57.3 |
| l) | length of Amorphous domain Å | 30.3 | 28.7 |
| m) | modulus of crystallite $10^6$ psi(GPa) | 1.25 (8.62) | 1.00 (6.9) |
| n) | modulus of amorphous, $10^6$ psi(GPa) | 0.32 (2.2) | 0.26 (1.79) |

II. Woven Body Construction and Evaluation

Webbings were constructed from nylon 6 and nylon 66 according to the specifications MIL-W-4088 Type XXVI dyed green, resin treated. The webbings were evaluated to determine webbing tensile property (tensile strength, elongation-to-break and energy to break) before and after frictional abrasion by FED-STD-191A, method 5309 and the temperature rise during abrasion loading; and webbing tensile property was measured also after tensile impacts over a 90° bending of ⅛ inch radius to an impact loading of 5,000 lb$_f$/ webbing at an average loading rate of 6,000 lb$_f$/ sec. and the temperature rise during impact loading was determined.

A. Frictional Abrasion Test

Figure 4:
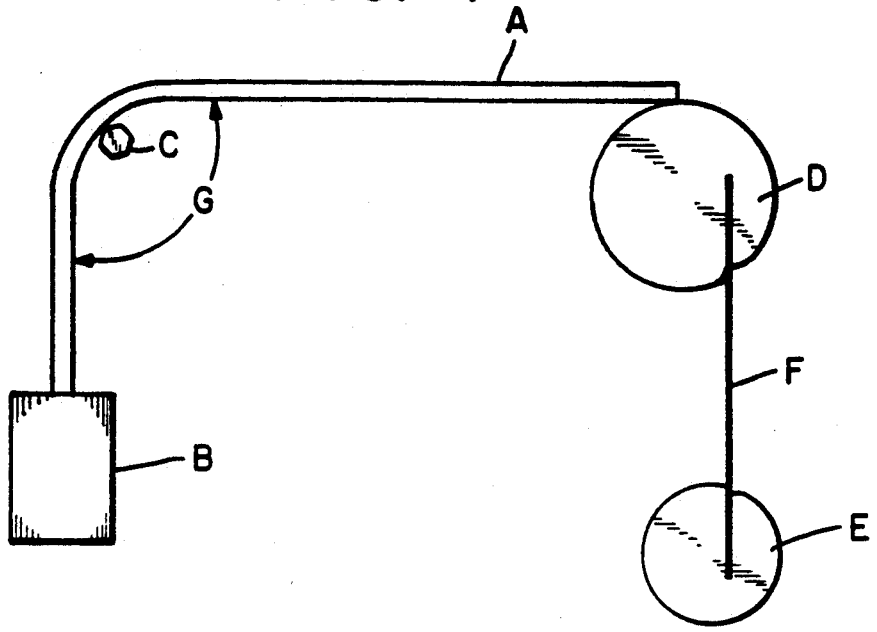
FIG. 4 is a depiction of the apparatus and woven body configuration during the frictional abrasion test.

In the test for the effect of cyclic frictional abrasion on the tensile properties of the webbing, one set of specimens from each type of webbing sample was abraded as per Federal Test Method Standard No. 191A, Method 5309.1 using the hex-bar abrader. This method calls for the webbing speciment to be given a 12-inch traverse over a hexagonal steel rod with a dimension of 0.250 inches between flat sides. The specimens were pulled across the rod 2500 times at a rate of 30 cycles per minute under a tension of 5.2 lb. The webbing configuration during this test is shown in FIG. 4. All tests were performed in the standard test environment of 70° F., 65% R. H.

The testing conditions are set forth in the following Table II.

TABLE II

| Frictional Abrasion Test Conditions | |
|---|---|
| Friction Medium | Hexagonal bar (as described below) |
| Friction cycle | 60 ± 2 strokes/min (30 ± 1 cycles) |
| Total stroke | 5,000 (2,500 cycles) |
| Load | 5.2 lbs ± 2 oz |
| Single stroke | 12 ± 1 inches |
| Number of specimens | 5 |

Examination of samples after abrasion showed that "napping" had occurred on some specimens. Repeated flexing of a woven fabric often causes filaments to reorganize between yarn intersections, particularly on the outside of the bend in the flexed region, and is affected by both yarn twist, pick spacing, and state of lubrication. The resulting napped structure is thicker and denser after flexing, and has a surface that resembles a highly napped fabric. All abraded specimens exhibited some evidence of napping; however, more extensive napping was observed on those nylon 6,6 specimens that were abraded on the "back" side. These specimens showed much more napping along the selvage that contained the catch cord. During the testing, webbing temperature was monitored by inserting a thin thermocouple wire at the section of webbing which was being abraded.

Figure 5:
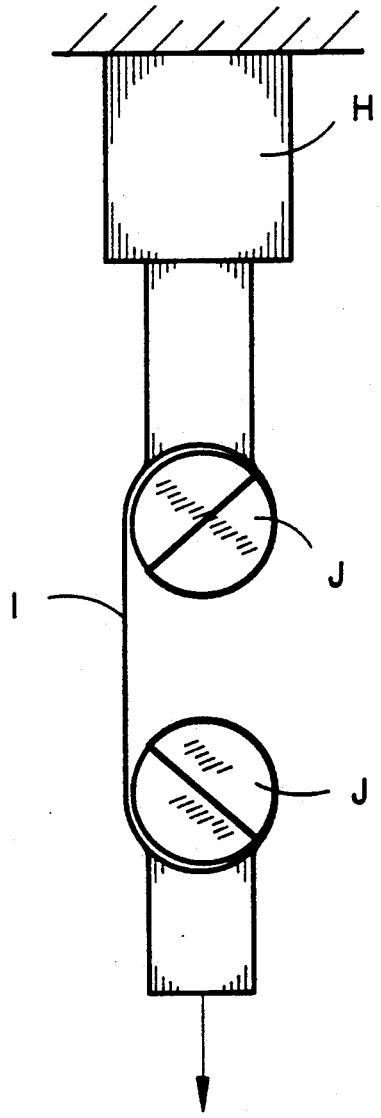
FIG. 5 is a depiction of the apparatus and woven body configuration during tensile testing.

After abrasion, the tensile properties of samples were tested. The abraded side of the sample was positioned on the outside of the wrap around the capstan jaws in these tests. Tensile properties of the webbing were measured by FED-STD-191A, Method 4108 before and after frictional abrasion. Tensile properties of all samples were measured according to Federal Test Method Standard No. 1991A, Method 4108. Following this method, all samples were conditioned and tested in a standard environment of 70° F., 65% relative humidity (RH). Five replicates were tested of each material. Testing was performed in an instron universal test acine (Model TTD), using 4-inch (10.2 cm) diameter split-capstan jaws. The specimen was held as in FIG. 5, with the lower jaw traveling at a speed of 2 inch/min (5.1 cm/min). An initial jaw separation of 10 inches (25.4 cm) was employed, determined at a preload of 200 lb (91 kg). Some tests were conducted with the "face" of the webbing on the outside of the wrap on the capstans, and some with the "back" side on the outside of the wrap. We define the "face" of the sample as the side which has the wrap yarns parellel to the webbing axis; the "back" of the sample has those yarns at an angle to the axis.

Elongation was measured by comparing the distance between gauge marks at the start of the test with the distance between marks as the specimen was tensioned. Gauge marks, 5.0 inches (12.7 cm) apart, were painted on the specimen after it was pretensioned to 200 lb (91 kg). A 35 mm camera was used to record the separation of the gauge marks, generally at 1000 lb (453.6 kg) increments throughout the test, but more frequently near failure of the specimen. Each photograph was keyed to a mark made on the Instron load trace. An average load - elongation diagram for each webbing type was calculated by averaging elongation values obtained from the developed film at each common load level up to break. The average breaking point is defined as the average breaking load at the average maximum recorded elongation. The results of the test are set forth in the following Table III.

TABLE III

Effect of frictional abrasion on the tensile properties of nylon 6 and nylon 66 webbing (Average of 5 samples)

| Parameter | Nylon 6 | Nylon 66 |
|---|---|---|
| A. Before Frictional Abrasion | | |
| i) Tensile Strength, total $lb_f$(Kg) to break | 15,500 (7030) | 17,500 (7938) |
| ii) Elongation to Break, % | 35.5 | 28.0 |
| iii) Energy to Break, lb-in/in (Kg-cm/cm) | 2,310 (1048) | 1,710 (776) |
| B. After Frictional Abrasion | | |
| i) Tensile Strength, total $lb_f$(Kg) to break | 15,000 (6804) | 13,100 (5942) |
| ii) Elongation-to-Break, % | 34.1 | 23.8 |
| iii) Energy-to-Break, lb-in/in (Kg-cm/cm) | 2,150 (975) | 1,010 (458) |
| C. Change in Tensile Properties | | |
| i) Change in Tensile Strength, % | −3.2 | −26.8 |
| ii) Change in Energy to Break, % | −6.9 | −40.9 |
| D. Maximum temperature rise, °C. (in 2,500 cycles) | 14.8 | 13.2 |

Table III shows that, during the frictional abrasion test, both of the webbings experienced loss in tensile strength but the are in tensile strength in nylon 66 webbing is almost an order or magnitude greater than that for the nylon 6 webbing. As to the energy to break, nylon 66 webbing shows considerably lower values than nylon 6 webbing both before and after the abrasion.

B. Impact Resistance Test

Figure 6:
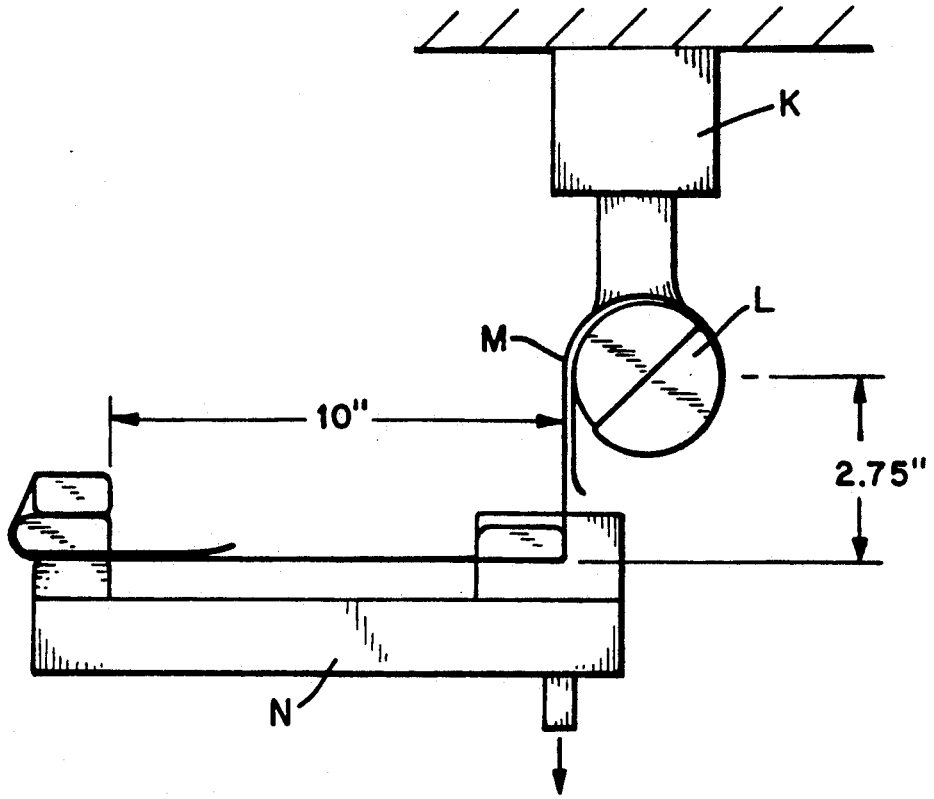
FIG. 6 is a depiction of the apparatus of woven body configuation during impact testing.
Figure 7:
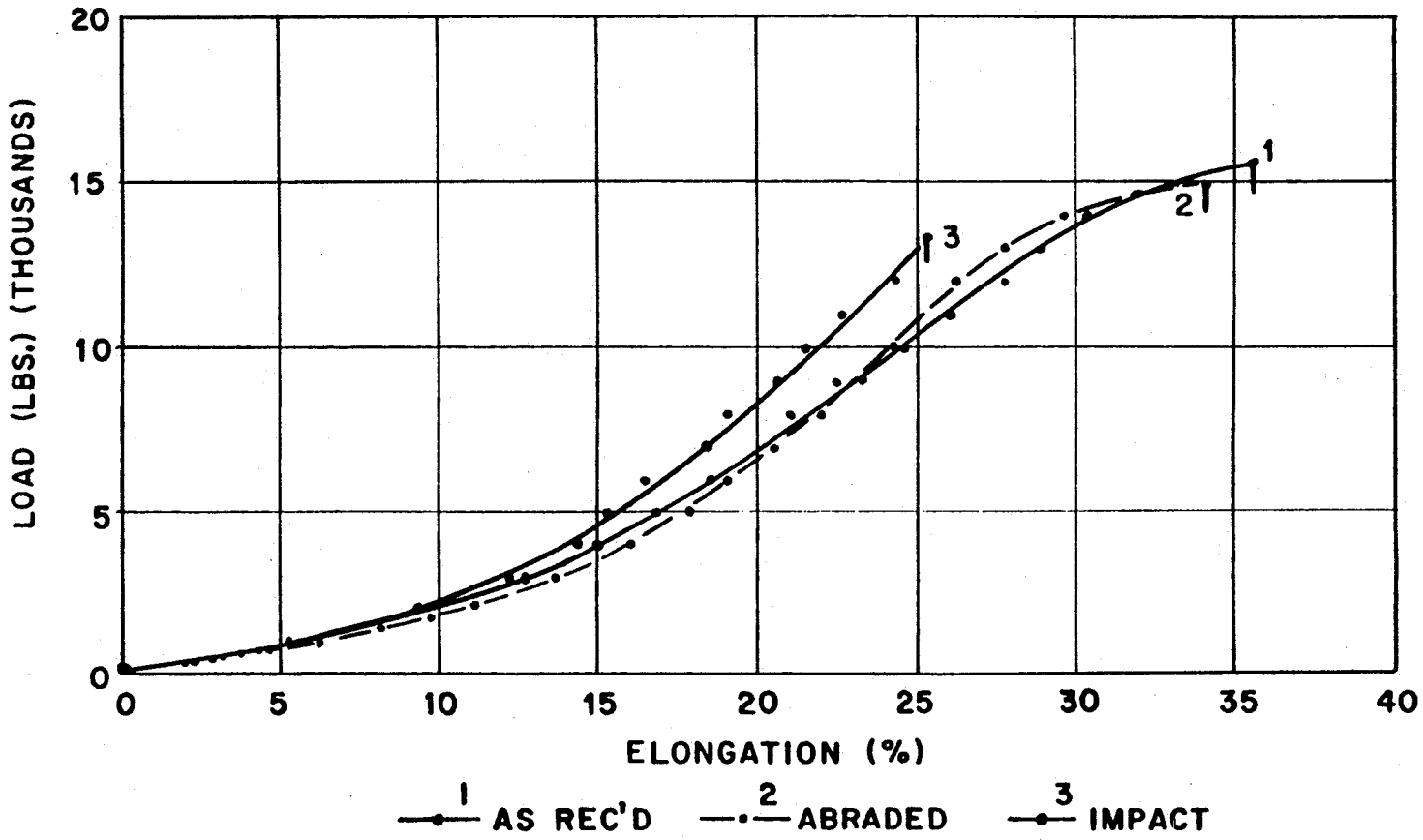
FIG. 7 is a graph of load as a function of % elongation for a nylon 6 woven body of this invention before testing, abraded and after impact testing.
Figure 8:
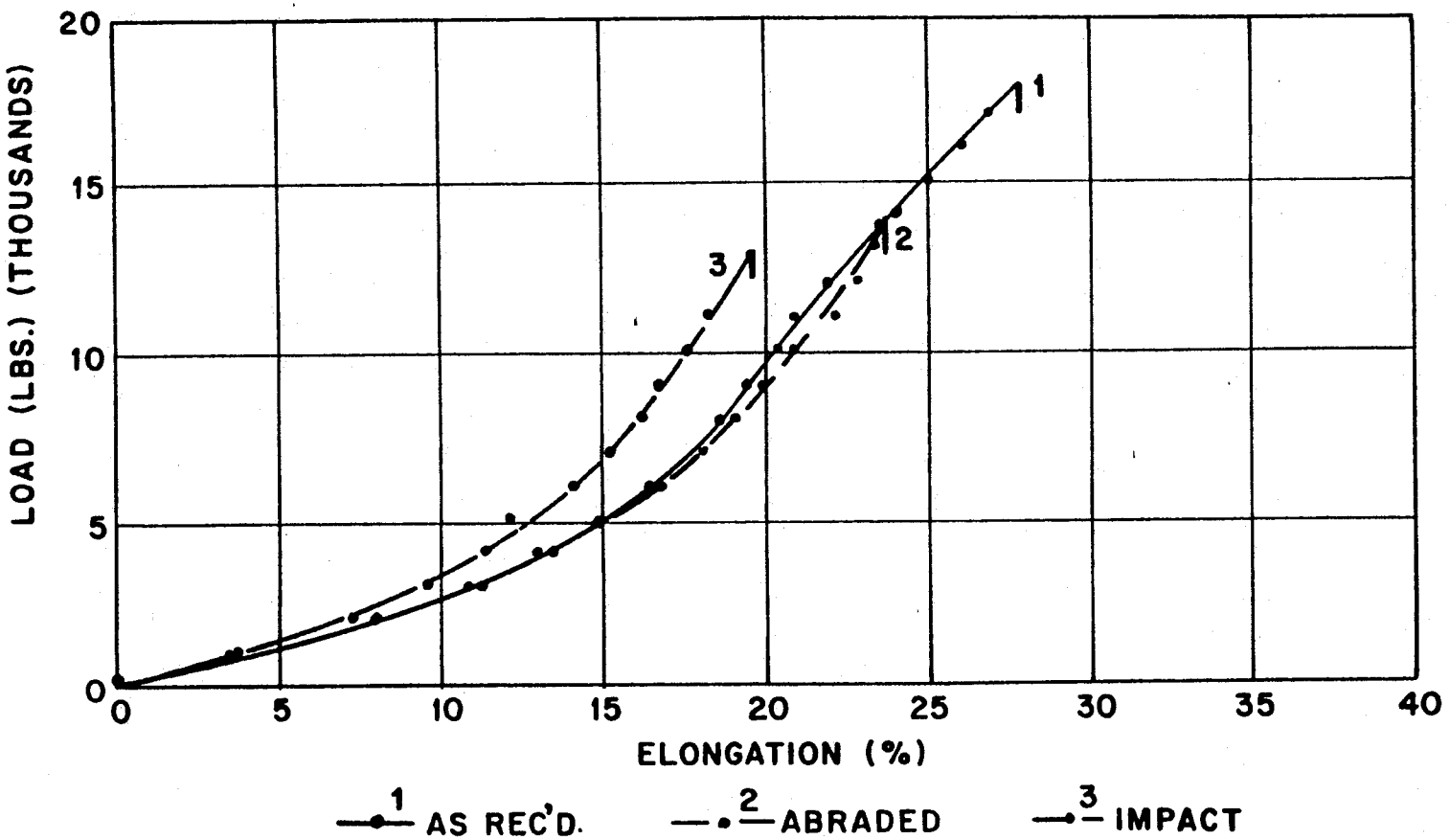
FIG. 8 is a graph of load as function of % elongation for a nylon 66 woven body before testing, abraded and after impact testing.

The webbings were tested for the effect of 10 tensile impacts and being over a 90° edge with ⅛ inch (0.32 cm) radius (impact loading 5,000 $lb_f$ (2268 kg) at average loading rate of 5,000~6,000 $lb_f$/sec (2268~2727 kg/sec) on the webbing strength and temperature rise. In the impact a MTS universal servohydraulic test machine (Model 810), with a maximum capacity of 20,000 lb (9072 kg), was used to apply a tensile impact load of 5000 lb (2268 kg) to webbing specimens bent 90° over a steel edge with a radius of 0.125 inches(0.32 cm). The webbing specimen was held in a self-tightening clamp at one end, threaded over the edge with a radius of ⅛ inch (0.32 cm) at an angle of 90°, and clamped at the other end as shown in FIG. 6. The load was applied by moving the fixture at the speed which would give average loading rate of 5,000~6,000 lbf/sec (2268~2722 Kg/sec) .Each test specimen was exposed to 10 consecutive high speed impact loadings at the same location. During the testing, the temperature rise caused by impact loading was measured by inserting a thermocouple at the center of the webbing specimen at the impact point. After 10 cycles of impact loading, the residual strength of webbing was measured by FED-STD-191A, Method 4108 described above.

The impact test conditions and the tensile properties of the nylon 6 and and nylon 66 test webbing before and after testing are set forth in the following Table IV.

TABLE IV

Impact Testing Conditions and Tensile Properties of webbing (Average values of 5 samples)

| Items | Nylon 6 | Nylon 66 |
|---|---|---|
| I. Impact Test Conditions | | |
| A. Maxiumum Load During Impact, $lb_f$(Kg) | | |
| i) Cycle 1 | 4,936 (2,244) | 5,400 (2,455) |
| ii) Cycle 10 | 4,779 (2,172) | 5,512 (2,505) |
| B. Average Load Rate, $lb_f$/sec (kg/sec) | | |
| i) Cycle 1 | 5,539 (2,518) | 5,285 (2,402) |
| ii) Cycle 10 | 5,838 (2,654) | 5,944 (2,702) |
| C. Maximum Load Rate, $lb/_f$/sec | | |

TABLE IV-continued

| Impact Testing Conditions and Tensile Properties of webbing (Average values of 5 samples) | | |
|---|---|---|
| Items | Nylon 6 | Nylon 66 |
| i) Cycle 1 | 7,299 (3,318) | 7,191 (3,268) |
| ii) Cycle 10 | 6,380 (2,900) | 8,123 (3,692) |
| II. Tensile Properties | | |
| A. Before Testing | | |
| i) Tensile strength Total $lb_f$ (Kg) to break | 15,500 (7031) | 17,900 (8119) |
| ii) Elongation to break % | 35.5 | 28 |
| iii) Energy to break lb-in/in (Kg-cm/cm) | 2,310 (1048) | 1,170 (776) |
| B. After 10 Cycles of Impact Loading | | |
| i) Tensile Strength, $lb_f$(Kg) | 13,610 (6173) | 13,000 (5897) |
| ii) Energy to break lb-in/in (Kg-cm/cm) | 1,140 (517) | 730 (331) |
| C. Change in Tensile Properties from Impact Testing | | |
| i) Change in Tensile Strength | −12.2 | −27.4 |
| ii) Change in Energy-to-Break | −50.6 | −57.3 |
| III. Temperature Rise in Webbing, °C. | | |
| After cycle 1 | 45 | 107.6 |
| After cycle 10 | 927.8 | 373.3 |

As seen in Table IV, impact load of 5,000 $lb_f$ was applied at loading rates of 5,500 $lb_f$/sec.

After 10 cycles of impact loading the tensile properties of the yarn (original yarn, not the yarn in the webbing) were also evaluated. The results are set forth in the following Table V. (Impact loading rate: 34000 $lb_f$/sec/webbing equivalent).

TABLE V

| Property | Nylon 6 | Nylon 66 |
|---|---|---|
| I Tensile Properties of Fibers (average of 4 samples) | | |
| a. Tensile Stength, g/denier | 8.03 | 9.38 |
| b. Initial Modulus, g/denier | 60.37 | 58.26 |
| c. Elongation to Break, % | 16.26 | 15.57 |
| d. Energy-to-Break, J/g | 58.53 | 58.58 |
| II Tensile Properties of Fibers After Impact Testing (average of 4 samples) | | |
| a. Tensile Strength, g/denier | 7.78 | 8.37 |
| b. Initial Modulus, g/denier | 54.10 | 57.11 |
| c. Elongation to Break, % | 14.81 | 13.68 |
| d. Energy to Break J/g | 46.72 | 41.67 |
| III % Retention of Tensile Properties | | |
| a. Tensile Strength | 96.9 | 89.2 |
| b. Initial Modulus | 89.6 | 98.0 |
| c. Elongation to Break, % | 91.1 | 87.9 |
| d. Energy to Break J/g | 79.8 | 71 |

Figure 17:
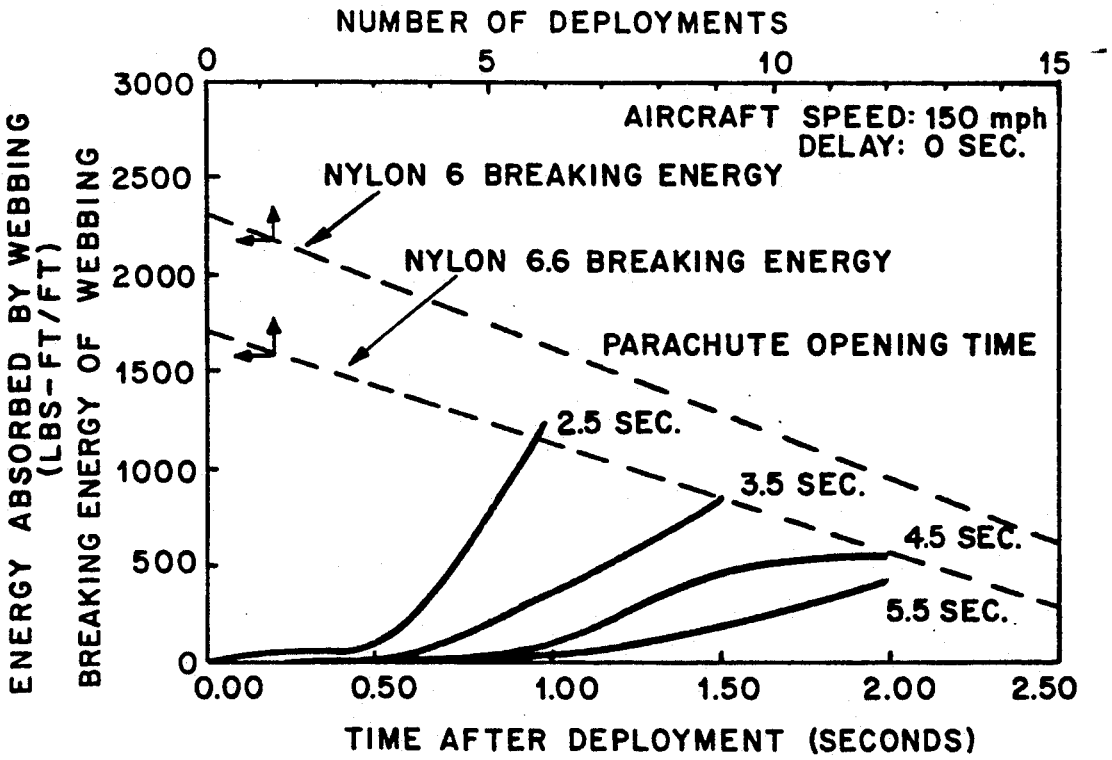
FIG. 17 is FIG. 10 superimposed over FIG. 15 showing the effect of parachute opening time on energy absorbed by the woven body and the decay of body breaking energy on repeated simulated deployments.
Figure 18:
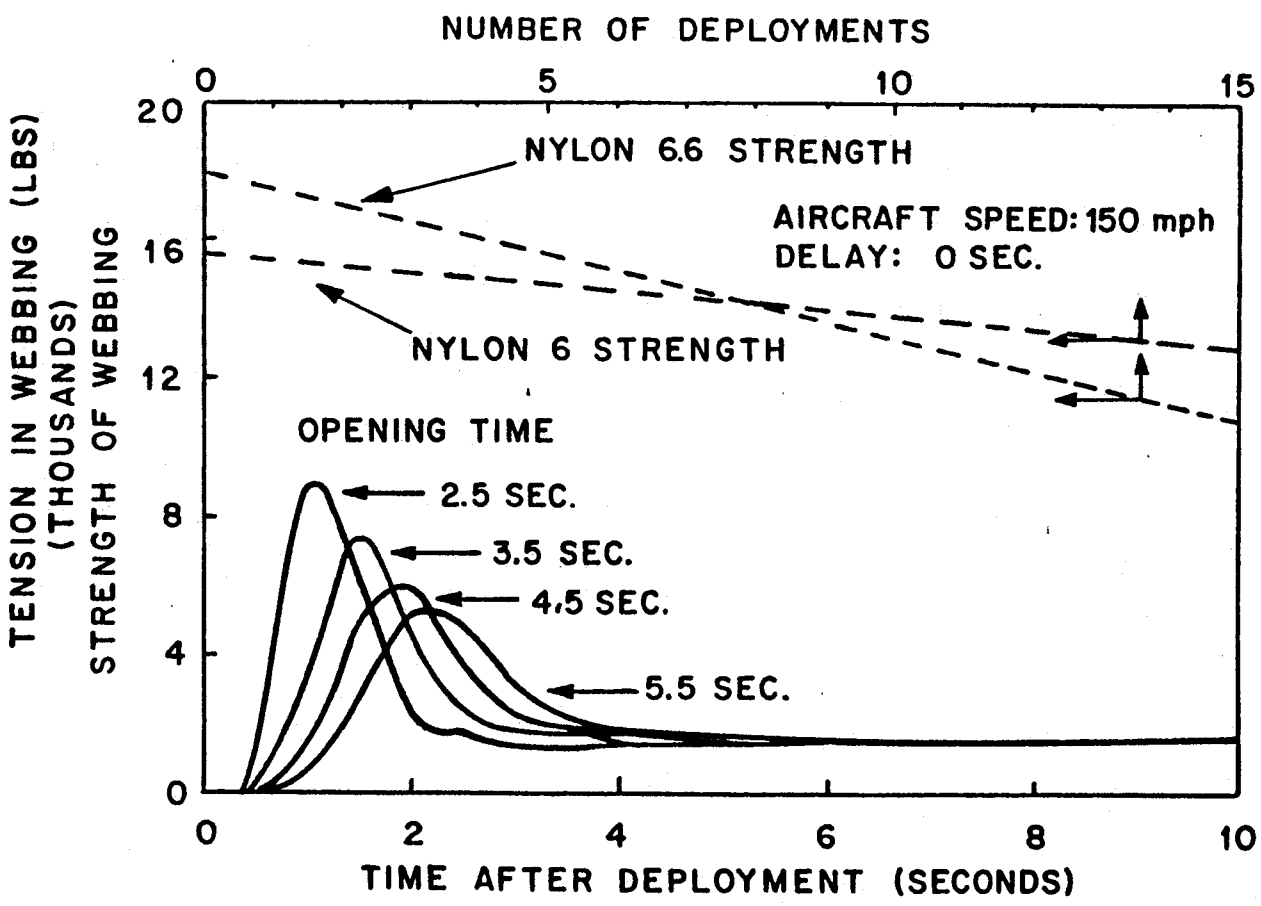
FIG. 18 is FIG. 9 superimposed over FIG. 13, showing the effect of parachute opening time on tension and the decay of body strength on repeated simulated deployments.

These results and the plots of load-elongation strain relationships (see FIG. 7 to 10) show that nylon 6 webbing has markedly better toughness, energy to break, impact resistance and that it maintains these properties better than nylon 6,6 webbing on repeated use. It is, therefore, very clear that nylon 6 yarn although equal in energy to break to the control nylon 66 yarn yields in the weave form a far superior product than the control nylon 66 yarn. This unexpected improvement is believed due to the morphological structure allowing a greater energy absorption on impact and severe handling. The comparison of tensile strength and energy to break as function of the number of simulated deployments is shown in FIG. 17 and 18.

EXAMPLE 2

A series of analysis were carried out to correlate experimental test results showing the importance of energy-to-break with mathematically obtained values of the magnitude and time sequence to strain energies and stresses in a parachute sling.

As a parachute inflates, it first assumes the shape of a tall drinking glass, but later lookes like a light bulb and then a mushroom cap. The inflation stage presents the investigator with a serious problem: a parachute's shape depends on the aerodynamic forces acting on its canopy, but the airflow, which generates aerodynamic forces, depends on the shape of the canopy. Adding to the complexity is the fact that the parachute and it's payload are decelerating rapidly dissipating its kinetic energy into kinetic energy of air molecules. As the parachute opens, it progressively gets larger moving each moment and increasing amounts of air. This in turn increases deceleration and strain energy of the parachute. Each of these phenomena is difficult to describe mathematically and makes the modeling task extremely complicated. Our interest is not in analyzing the exact dynamic behavior of parachute but in analyzing the effect of the static and dynamic behavior of parachute on the sling, a component of parachute. Therefore, the dynamic behavior of parachute systems will be analyzed with emphasis on the parameters affecting the sling behavior during deployment.

To predict the behavior of a parachute, one has to solve the equations of motion for the parachute while at the same time solving the equations of motion for the air around the parachute. No one has yet succeeded at this task. But investigators can simplify the problem by focusing on a particular function at a parachute's part or by neglecting certain parameters, which are not important in the dynamic behavior of parachutes. They can then test the accuracy of their approimate prediction by comparing them with data obtained from actual test experiments. In this way, they can determine the important parameters for each stage of inflation and parachute part and adjust their computer models to reproduce the phenomena observed experimentally. We used this procedure in our analysis.

The general equations of motion for the parachute system can be written, based on the Newton's laws of motion, as:

$$F_i = P_i + \epsilon_{ijk}\omega_j P_k$$

$$M_i = H_i + \epsilon_{ijk} V_j P_k + \epsilon_{ijk}\omega_j H_k$$

where $P_i$ and $H_i$ are linear and angular momenta, $V_i$ and $w_j$ the linear and angular velocities, and $F_i$ and $M_i$ the forces and moments acting on the system, respectively. The upper dot denotes differentiation with respect to time. Equations (1) and (2) are a system of differential equations which represent the governing equations of the dynamic behavior of parachute systems.

In solving these equations, several assumptions were made to idealize the parachute deployment process but still without losing realistic aspects. Then these equations were solved numerically using the fourth order Runge-Kutta method subject to appropriate initial conditions. From the solution of these equations, we developed approximations to estimate the magnitude and time sequence of strain energies and stresses in the sling, verify the output and then proceed to optimize the material, outline a satisfactory testing procedure, and test the results used to optimize the construction and materials.

Figure 12:
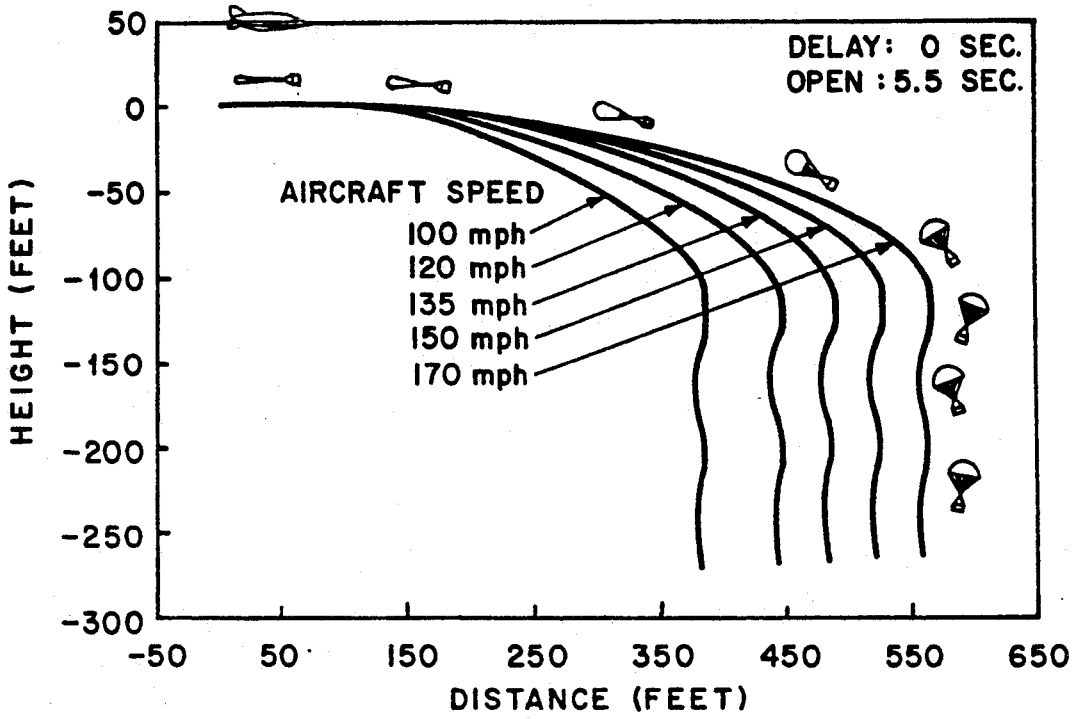
FIG. 12 is a graph of parachute deployment height as a function of the linear distance of ground impact from point of deployment showing the effect of aircraft speed on trajectory of cargo.
Figure 13:
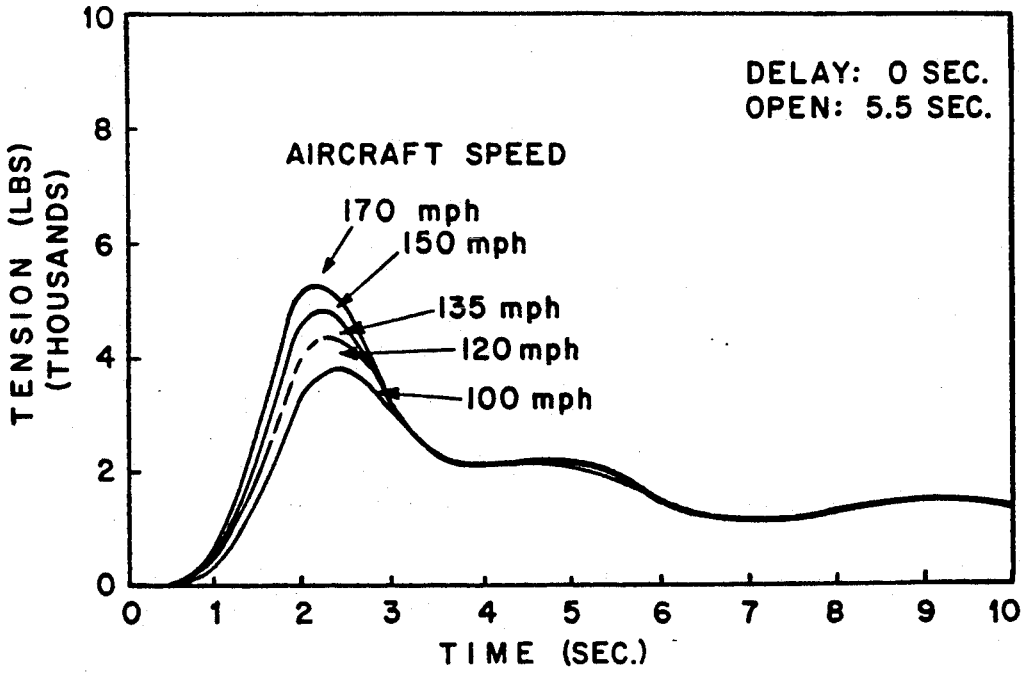
FIG. 13 is a graph of tension in the parachute sling as a function of time after deployment showing the effect of aircraft speed on tension.
Figure 14:
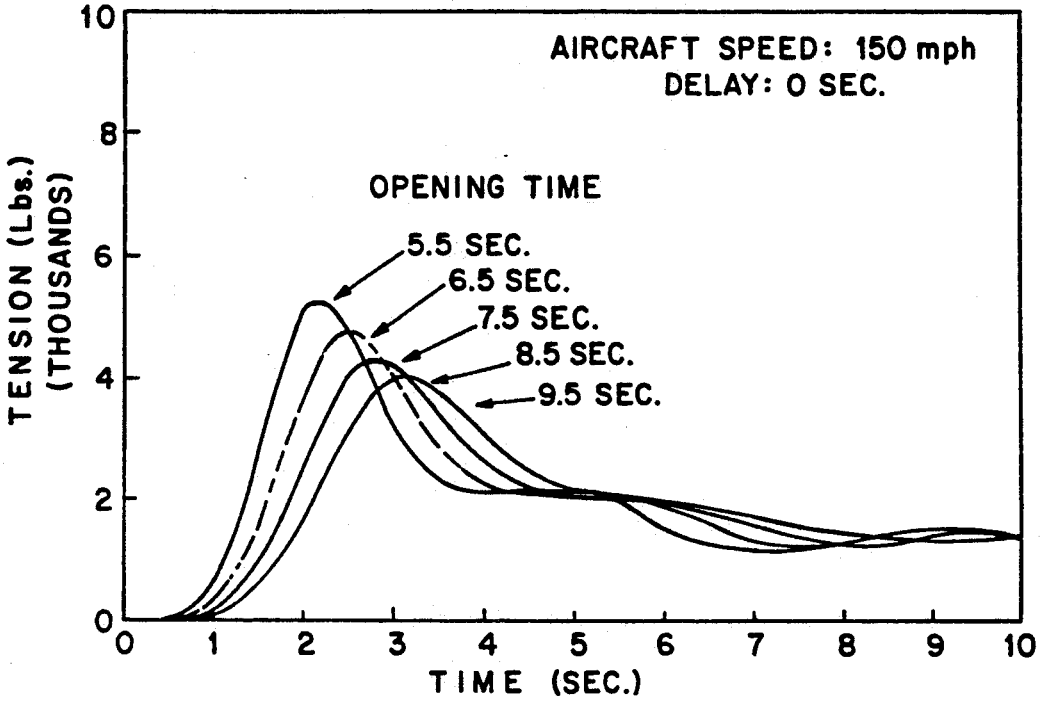
FIG. 14 is a graph of tension in the parachute sling as a function of time after deployment showing the effect of parachute opening time on the tension in the sling.
Figure 15:
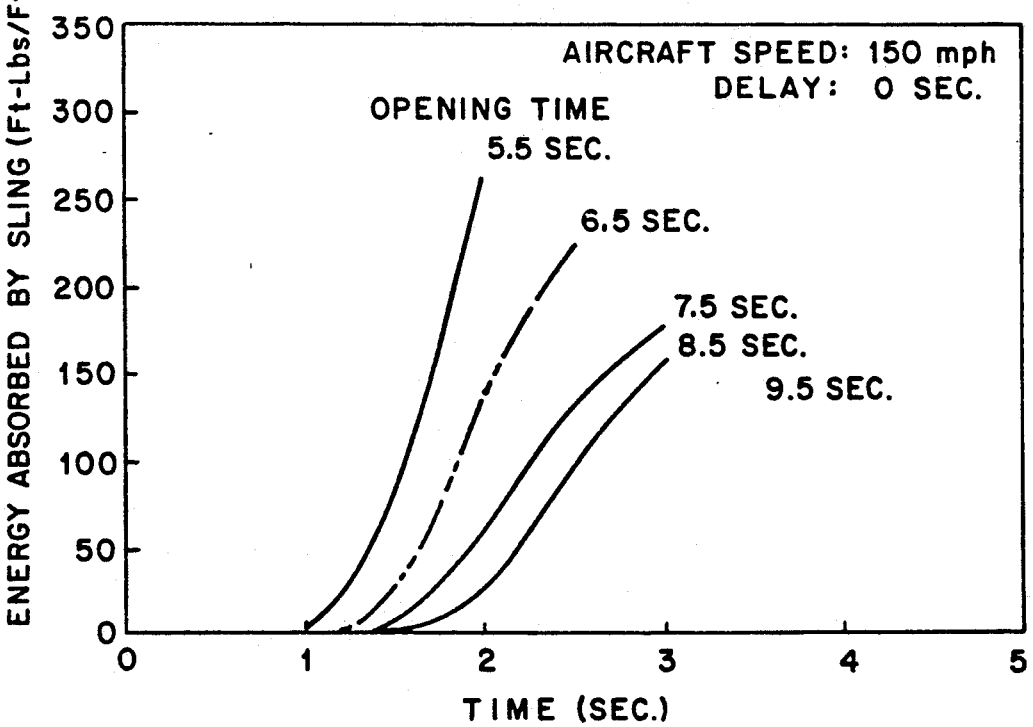
FIG. 15 is a graph of energy absorbed by the parachute sling during deployment as a function of time after deployment showing the effect of parachute opening time on energy absorbed by the sling.

Some typical results are presented in FIGS. 12 through 16. FIG. 12 depicts the simulated trajectory of an 8 parachute cluster with 42,000 pound payload. In FIG. 13, the tension in the sling is shown. As can be seen, the tension during the early parachute opening phase is much higher than that during the steady descending period. As a result, the sling experiences a strong impact and absorbs the impact energy as shown in FIG. 15.

The key parameters affecting the dynamic behavior of parachute include the aircraft speed, duration of parachute opening and delay of parachute opening. The aircraft speed has a significant effect on the tension of sling and the amount of energy absorbed by the sling is largely influenced by the parachute opening process.

The analysis results show that during the parachute opening, the aerodynamic force acting on the canopy increases rapidly, resulting in sudden deceleration, which causes impact on the sling. The faster the parachute opens, the greater the impact energy. Consequently, the material used for the sling must have, in addition to sufficient strength, also high energy absorption capability. However, the current webbing constructions are based on the strength criteria. Therefore, the energy absorption capability must be recognized as one of the critical property requirements for the sling material.

Figure 16:
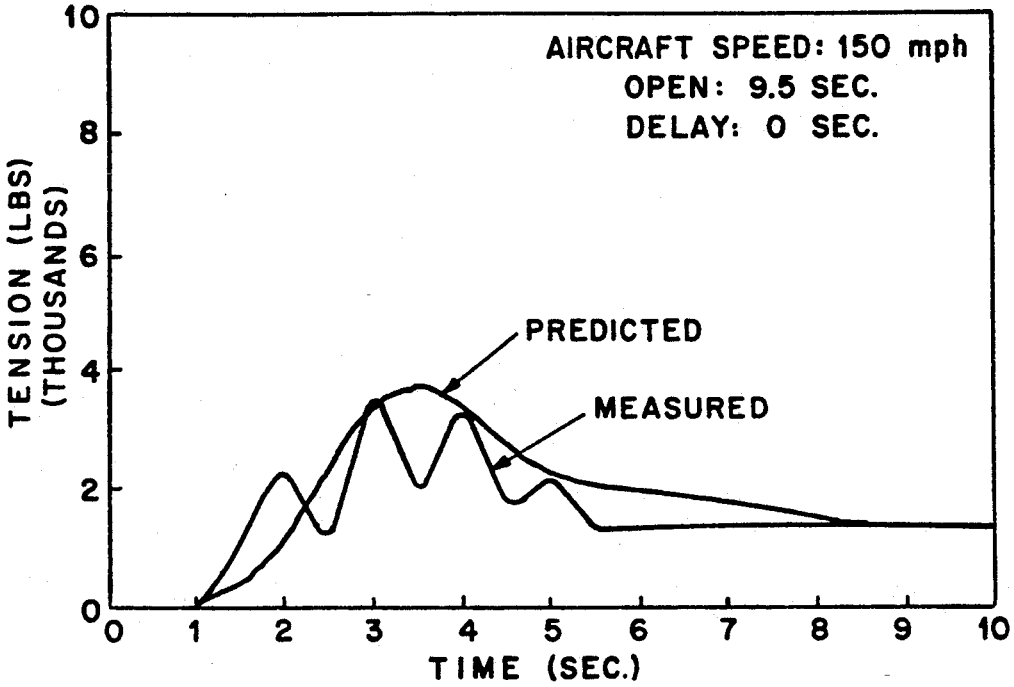
FIG. 16 is a graph of tension in the parachute sling as a function of time after deployment which compares the experimentally determined tension as a function of time with tension predicted from the analysis method.

The analysis results were compared with experimental data to verify the validity of our mathematical model. In FIG. 16, the predicted tension in the sling is compared with the experimentally measured tension during actual deployment at an aircraft speed of approximately 150 miles per hour. As can be seen, the magnitude of predicted tension is in good agreement with the measurements. The difference is due to the swaying of payload, which was not considered important in our analysis.

Based on this analysis and experimental results, it was determined that the following material properties are the key criteria for the selection of sling material:

$T_g$ (glass Transition Temperature)

Temperature rise under frictional abrasion and impact or cyclic load

Strength

Energy-to-break (energy absorption capacity)

Loss of strength and energy-to-break on repeated use

The sling material should have a $T_g$ high enough to withstand the temperature rise due to surface friction so that its strength will not be impaired. The next concern is the temperature rise due to viscolelastic loss and friction under cyclic or impact loads. Low viscous dissipation and friction characteristics are desirable for the sling material. In regard to the mechanical properties, the material used for the sling must have high energy absorption capability as well as sufficient strength.

Since the sling is designed for repeated use, the final consideration is the damage tolerance and property retention on repeated loadings. In general, the damage caused by the application of loads is a function of the ratio of the loads to the material capacities, e.g., ratio of energy absorbed to energy-to-break. The higher the ratio gets, the greater the damage becomes. Materials with higher energy-to-break tend to have higher damage tolerance.

Figure 10:
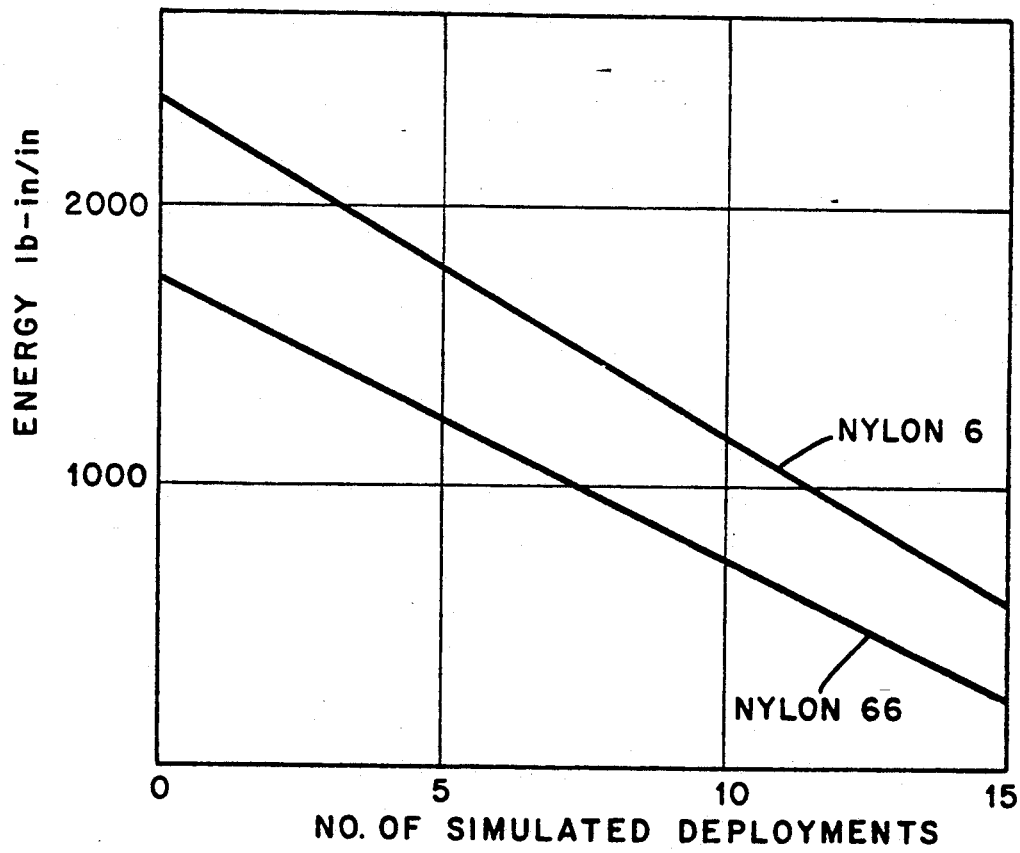
FIG. 10 is a graph of energy-to-break as a function of the number of simulated deployments for a nylon 6 body of this invention and for a nylon 66 woven body.
Figure 11:
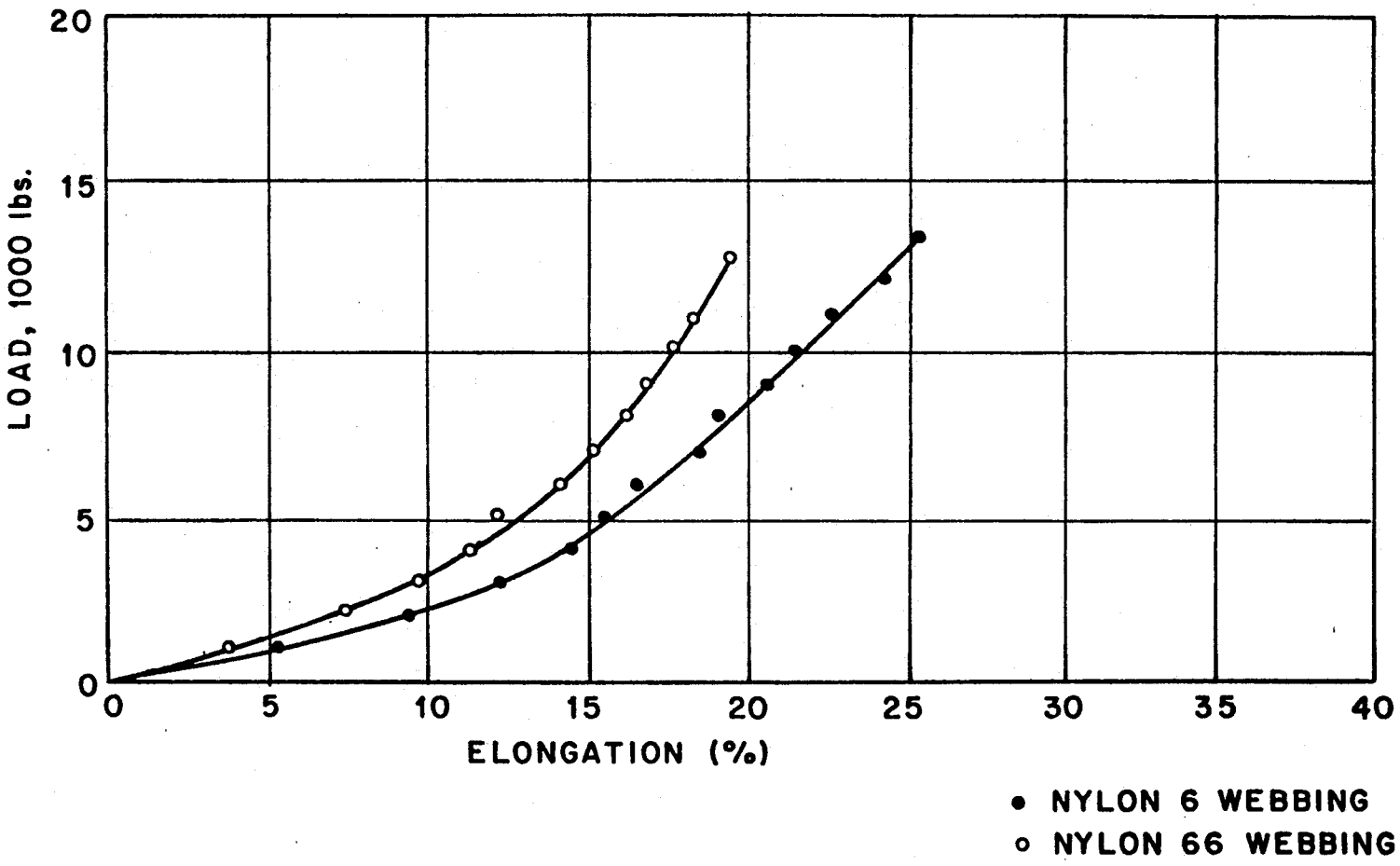
FIG. 11 is a graph of load as a function of % elongation for a nylon 6 woven body of this invention and a nylon 66 woven body after 10 cycles of impact loading in the impact test.

In FIG. 17, actual experimental data showing the reduction in energy of nylon 6 and nylon 66 woven bodies as a function of the number of deployments in FIG. 10 is superimposed over the analysis data in FIG. 15 showing the effect of parachute opening time on energy absorbed by the woven body. The results in FIG. 17 show that, in each case the woven body formed from nylon 6 had a higher energy absorption capability to absorb the energy of impact over repeated use than the woven body formed from nylon 66.

Figure 9:
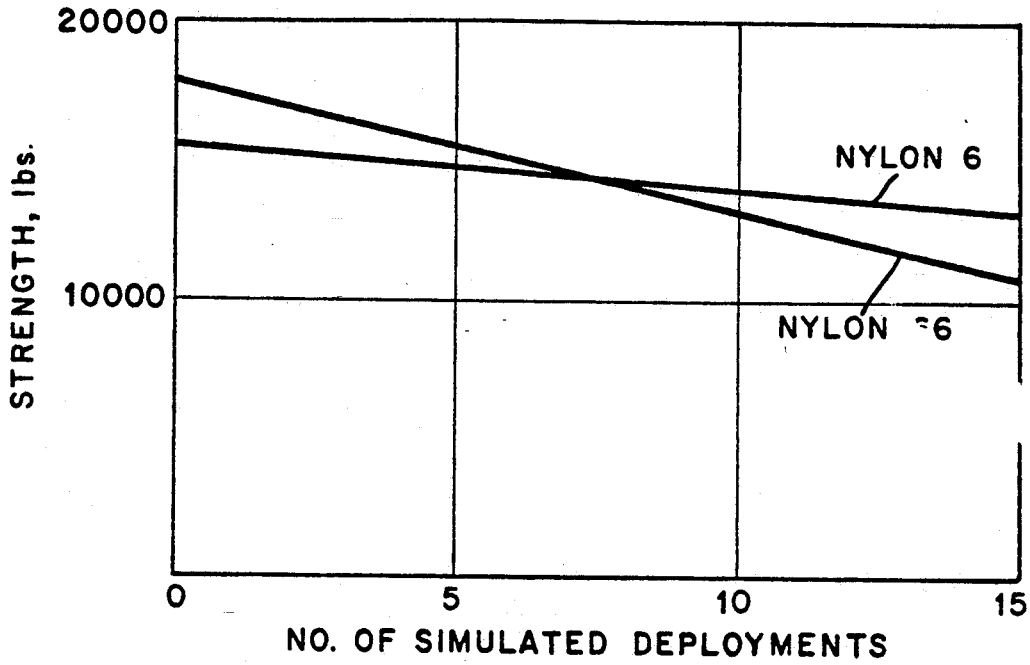
FIG. 9 is a graph of strength as a functions of the number of simulated deployments for a nylon 6 woven body of this invention and for a nylon 66 woven body.

In FIG. 18, actual experimental data showing the reduction in tensile strength of nylon 6 and nylon 66 woven bodies as a function of the number of deployments in FIG. 9 is superimposed over analysis data in FIG. 14 showing the effect of parachute opening time on the tension in the woven body. The results in FIG. 18 show that initially the nylon 66 woven body has a higher strength than the nylon 6 woven body and that the strength of both bodies exceeds the tension in the body during deployment. However, that data also shows that the strength of the nylon 66 woven body decays at a faster rate on repeated deployment than the nylon 6 woven body. Assuming, contribution of the linear relation, the nylon 66 woven body would fail after fewer deployments than the nylon 6 woven body. It is believed that the superior performance of the nylon 6 woven body as compared to the nylon 66 woven body result largely from differences in the morphological structure. The size of crystallites and the degree of crystallinity are believed to be the major factor; and any fiber having a minimum tensile strength (equal to or greater than about 6 g/denier) and having smaller crystallite size and a large degree of crystallinity than that of the nylon 66 evaluated will exhibited superior performance.

EXAMPLE 3

Using the procedure of Example 1, a series of experiments were carried out to determine the effect of abrasion on tensile strength and energy to break of webbings 1 and 2 constructed of nylon 6 and nylon 66, respectively, obtained from one source, and webbings 3 and 4 constructed of nylon 6 and nylon 66, respectively, obtained from another source. The results of these experiments are set forth in the following Table VI:

TABLE VI

| Item | Nylon 6 Webbing 1 | Nylon 66 Webbing 2 | Nylon 6 Webbing 3 | Nylon 66 Webbing 4 |
|---|---|---|---|---|
| A. AS RECEIVED | | | | |
| 1. Tensile Strength (TS) $lb_f$(Kg) | 15,500 (7030) | 17,900(8119) | 16,075 (7291) | 17,210 (7806) |

TABLE VI-continued

| Item | Nylon 6 Webbing 1 | Nylon 66 Webbing 2 | Nylon 6 Webbing 3 | Nylon 66 Webbing 4 |
|---|---|---|---|---|
| 2. Energy to Break (EB) lb-in/in (kg-cm/cm) | 2,310 (1048) | 1,710(776) | 1,754 (769) | 1,985 (400) |
| 3. EB/TS ratio | 0.149 | 0.096 | 0.109 | 0.115 |
| B. AFTER 2500 CYCLE ABRASION | | | | |
| 1. Tensile strength lbf (Kg) | 15,000 (6804) | 13,100(5942) | 7,900 (3583) | 6,600 (2994) |
| 2. Energy to break lb-in/in (kg-cm/cm) | 2,150 (975) | 1,010(458) | 1,552 (704) | 1,002 (454) |
| C. CHANGE IN PROPERTIES | | | | |
| 1. Tensile Strength | | | | |
| i. Retention (%) | 96.8 | 73.2 | 49.1 | 38.3 |
| ii. loss (%) | 3.2 | 26.8 | 50.9 | 61.7 |
| 2. Energy to Break | | | | |
| i. Retention (%) | 93.1 | 59.1 | 88.5 | 50.4 |
| ii. Loss (%) | 6.9 | 40.9 | 11.5 | 49.6 |

What is claimed is:

1. A woven article of manufacture comprising a woven fibrous network of a plurality of polymeric fibers wherein the tenacity of said fibers in said network is equal to or greater than about 5 grams/denier (g/d), wherein the ratio of energy-to-break (lbf-in/in) of said article to the tensile strength (lbf) of said article is equal to or greater than about 0.105, and wherein the % change in energy-to-break of said article after the Impact Resistance Test is less than about 55% based on the energy-to-break of said article prior to testing and % change in the tensile strength of said article after said Impact Resistance Test is at least about 25% based on the tensile strength of said article before said testing.

2. An article of claim 1 wherein said ratio is equal or greater than about 0.0105.

3. An article of claim 1 wherein said ratio is equal to or greater than a 0.110.

4. An article of claim 3 wherein said ratio is from about 0.110 to about 0.15.

5. An article of claim 4 wherein said ratio is from out 0.110 to about 0.125.

6. An article of claim 1 wherein said % reduction in energy-to-break is less than about 60.

7. An article of claim 6 wherein said % reduction is energy-to-break is less than about 56.

8. An article of claim 7 wherein said % reduction in energy-break is less than about 52.

9. An article of claim 2 wherein said % reduction in energy-to-break is less than about 50.

10. An article of claim 6 wherein said % reduction in tenacity is less than about 30.

11. An article of claim 10 wherein said % reduction in tenacity is less than about 20.

12. An article of claim 11 wherein said % reduction in tenacity is less than about 16.

13. An article of claim 12 wherein said % reduction in energy-to-break is less than about 13.

14. The article of claim 10 wherein said tenacity is at least about 5 grams/denier (g/d) and said fiber has an energy-to-break of at least about 50 joules/gram (j/g).

15. The article of claim 14 wherein said tenacity is from about 6 to about 12 g/d.

16. The article of claim 10 wherein said article has a % reduction in energy-to-break (lbf-in/in) after the Abrasion Resistance Test of less than about 30 based on the energy-to-break of the article prior to testing.

17. The article of claim 16 wherein said % reduction in energy-to-break of said article after the Abrasion Resistance Test is less than about 25.

18. The article of claim 17 wherein said % reduction in energy-to-break of said article after Abrasion Resistance Test is less than about 20.

19. The article of claim 17 wherein said % reduction in energy-to-break of said article after Abrasion Resistance Test is less than about 15.

20. The article of claim 17 wherein said article has a % reduction in tenacity (lbf) after the Abrasion Resistance Test of less than about 55 based on the tenacity of the article prior to testing.

21. The article of claim 20 wherein said % reduction in tenacity after the Abrasion Resistance Test is less than about 40.

22. The article of claim 21 wherein said % reduction in tenacity after the Abrasion Resistance Test is less than about 20.

23. The article of claim 22 wherein said % redaction in tenacity is less than about 5.

24. The article of claim 24 wherein said fibers have crystalline domains and amorphous domain.

25. The article of claim 24 wherein said fiber has a degree of crystallinity of less than 70%.

26. The article of claim 25 wherein said degree of crystallinity is equal to or less than about 68%.

27. The article of claim w wherein said degree of crystallinity is equal to or less than about 66%.

28. The article of claim 27 wherein said degree of crystallinity is equal to or less than about 62%.

29. The article of claim 26 wherein crystallites in said crystalline domain have crystallites of less than 60.7 Å in length.

30. The article of claim 29 wherein the said crystallites are less than about 60 Å in length.

31. The article of claim 30 wherein said crystallites are from about 50 about 60 Å in length.

32. The article of claim 31 wherein said crystallites are from about 55 to about 59 Å in length.

33. The article of claim 31 said crystallite Scherrer length is equal to or greater than about 250 Å.

34. The article of claim 29 wherein said Scherrer length is equal to or greater than about 350 Å.

35. The article of claim 34 wherein said Scherrer length is equal to or greater than about 450 Å.

36. The article of claim 35 wherein said Scherrer length is equal to or greater than about 550 Å.

37. The article of claim 36 wherein said Scherrer length is equal to or greater than about 650 Å.

38. The article of claim 37 wherein said Scherrer length is equal to or greater than about 750 Å.

39. The article of claim 1 wherein said fiber is a polyamide, a polyester or a combination thereof.

40. The article of claim 39 wherein said fiber is a polyamide fiber.

41. The article of claim 40 wherein said polyamide fiber is a nylon 6 fiber or a nylon 66 fiber.

42. The article of claim 41 wherein said polyamide fiber is a nylon 6 fiber.

43. An article of manufacture for aerial deployment of a cargo, said article comprising a parachute which comprises a canopy having liner attached thereto and having one or more woven articles of claim 1 attached to said lines for attachment of said cargo to said article.

* * * * *

UNITED STATES PATENT AND TRADEMARK OFFICE

CERTIFICATE OF CORRECTION

PATENT NO. : 5,260,122

DATED : November 9, 1993

INVENTOR(S) : Prevorsek et al.

It is certified that error appears in the above-identified patent and that said Letters Patent is hereby corrected as shown below:

Col. 17, line 33, after the word "equal" insert --to--
Col. 17, line 35, "claim 1" should read "claim 2"
Col. 17, line 39, delete "out" and insert --about--
Col. 17, line 41, "claim 1" should read "claim 2"
Col. 18, line 36, delete "redaction" and insert --reduction--
Col. 18, line 38, "claim 24" should read "claim 21"
Col. 18, line 44, "claim w" should read "claim 26"

Signed and Sealed this

Nineteenth Day of April, 1994

Bruce Lehman

*Attest:*

BRUCE LEHMAN

*Attesting Officer*

*Commissioner of Patents and Trademarks*